US011136740B1

(12) United States Patent
Du

(10) Patent No.: US 11,136,740 B1
(45) Date of Patent: Oct. 5, 2021

(54) UNDERWATER TRAFFIC TUNNEL

(71) Applicants: Di Du, Liaoning (CN); Yang Du, Siping (CN)

(72) Inventor: Di Du, Liaoning (CN)

(73) Assignees: Di Du, Liaoning (CN); Yang Du, Siping (CN)

( * ) Notice: Subject to any disclaimer, the term of this patent is extended or adjusted under 35 U.S.C. 154(b) by 0 days.

(21) Appl. No.: 17/079,673

(22) Filed: Oct. 26, 2020

(30) Foreign Application Priority Data

Jul. 28, 2020 (CN) ..... 202010738096.7

(51) Int. Cl.
*E21F 1/00* (2006.01)
*E02D 29/067* (2006.01)

(52) U.S. Cl.
CPC ..... *E02D 29/067* (2013.01); *E21F 1/003* (2013.01)

(58) Field of Classification Search
CPC ..... E02D 29/067; E21F 1/003; E01B 25/00
USPC ..... 405/134–137, 132, 151–153
See application file for complete search history.

(56) References Cited

U.S. PATENT DOCUMENTS 1,405,728 A * 2/1922 Tervo ..... B63G 8/41 114/323
4,657,435 A * 4/1987 Chang ..... E02D 29/063 405/136
5,322,390 A * 6/1994 Niimura ..... E02D 29/063 405/136
5,823,714 A * 10/1998 Chattey ..... E02D 25/00 405/204
5,899,635 A * 5/1999 Kuja ..... E02D 29/067 405/136
2010/0092243 A1* 4/2010 Bauder ..... E02D 29/067 405/136
2013/0071189 A1* 3/2013 Aston ..... E01F 5/005 405/126

* cited by examiner

*Primary Examiner* — Edwin J Toledo-Duran
(74) *Attorney, Agent, or Firm* — Bay State IP, LLC

(57) ABSTRACT

An underwater traffic tunnel that includes a body immersed in water, a connector, and a ventilation system. The body comprises a first cavity for providing a passage space and a second cavity located below the first cavity. The second cavity is in communication with water; the connector connects the body and the water bottom and is used to resist buoyancy, and the ventilation system is in communication with the first cavity and extends above the water surface; the body of the present invention is safely immersed in water, and a vessel can navigate freely above the body; the second cavity is in communication with water and is not easy to be overturned by seawater; the connector resists buoyancy; the ventilation system can prevent damage by external forces through deformation and movement, and an escape system can be activated in emergency situations.

9 Claims, 9 Drawing Sheets

UNDERWATER TRAFFIC TUNNEL

CROSS REFERENCE TO RELATED APPLICATION

This application claims the benefit of and takes priority from Chinese Patent Application Serial No. 202010738096.7 filed on Jul. 28, 2020, the contents of which are herein incorporated by reference.

BACKGROUND OF THE INVENTION

Field of the Invention

The present invention relates to the technical field of traffic bridges and tunnels, in particular to an underwater traffic tunnel.

Description of the Related Art

Economic development has promoted the growth of traffic demand and accelerated the development of sea-crossing projects. At present, there are mainly two types of traffic buildings between two coasts with a great span: sea-crossing bridges and subsea tunnels.

The applicant found that the prior art has at least the following technical problems:

The first type of sea-crossing bridge is very difficult to construct. Generally, steel bars are driven deep into the ground, and then cement is poured to form piers, and finally the bridge body on the sea surface is built. Due to the changeable and severe environment of the sea, it is very difficult for the structure of this type of bridges to ensure safety and stability between two coasts with a large span.

The second type of subsea tunnels does not hinder the navigation of ships on the water and is not affected by meteorological conditions such as strong wind and fog. However, it is completely built on the seabed and is greatly affected by crustal changes, seawater pressure, tsunamis, etc., and the seabed geological structure is complex. Therefore, there is a greater risk for the construction of traffic bridges and tunnels on the seabed, and the stability and safety are poor; in addition, it is also difficult to solve safety issues such as ventilation problems and water ingress prevention.

In response to the above problems, the applicant has developed a marine tunnel, which comprises a first cavity protruding wholly or partly from the sea surface and a second cavity immersed in the seawater. However, the applicant found that although the above sea tunnel is not easily affected by crustal movement, and there is a part extending out of the sea surface, which affects the navigation of ships above the traffic tunnel to a certain extent.

In view of this, how to obtain a bridge and tunnel with a small impact on seaborne or waterborne ships and a stable structure has become an urgent problem to be solved.

SUMMARY OF THE INVENTION

The object of the present invention is to provide an underwater traffic tunnel to solve the existing technical problem in the prior art that it is difficult for the existing sea and subsea (water bottom) and underwater traffic tunnels to ensure structural stability without interacting with the passing ships; many technical effects that can be produced by the preferred technical solutions among many technical solutions provided by the present invention are described in detail hereinafter.

In order to achieve the above object, the present invention provides the following technical solutions.

Compared with the prior art, the underwater traffic tunnel provided by the present invention has the following beneficial effects: the body is safely immersed in water, it is not easy to interact with marine vessels, and the vessel can navigate freely above the body; at the same time, the second cavity is in communication with water, when seawater impacts one side of the body, since the second cavity is immersed in the seawater, the seawater can enter the second cavity, the body is not easy to be overturned by the seawater, and the flow of the seawater plays a certain counterweight role. The stability is better; the connector is stable and firm against the buoyancy of the body and the impact of seawater on the side wall of the body; the ventilation system on the body can deform and move when impacted to prevent damage and impact by external forces, ensuring that the traffic tunnel has good ventilation guarantee and is safer, and can reduce the impact of changes in the earth crust such as earthquakes on the body of the tunnel.

BRIEF DESCRIPTION OF THE DRAWINGS

In order to explain the embodiments of the present invention or the technical solutions in the prior art more clearly, the drawings that need to be used in the description of the embodiments or the prior art will be briefly introduced.

DETAILED DESCRIPTION OF THE SEVERAL EMBODIMENTS

Figure 1:
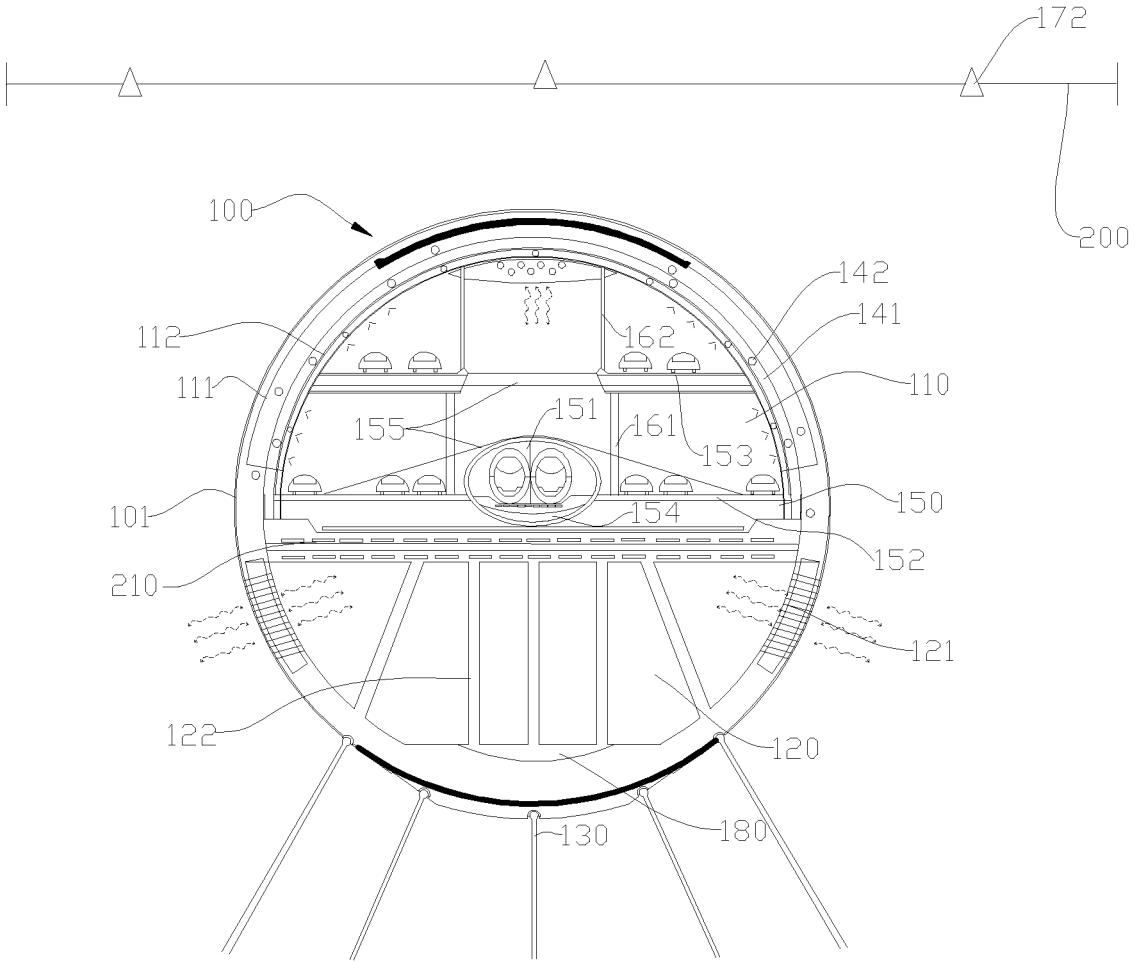
FIG. 1 is a schematic diagram of a first perspective of an underwater traffic tunnel according to an embodiment of the present invention.
Figure 2:
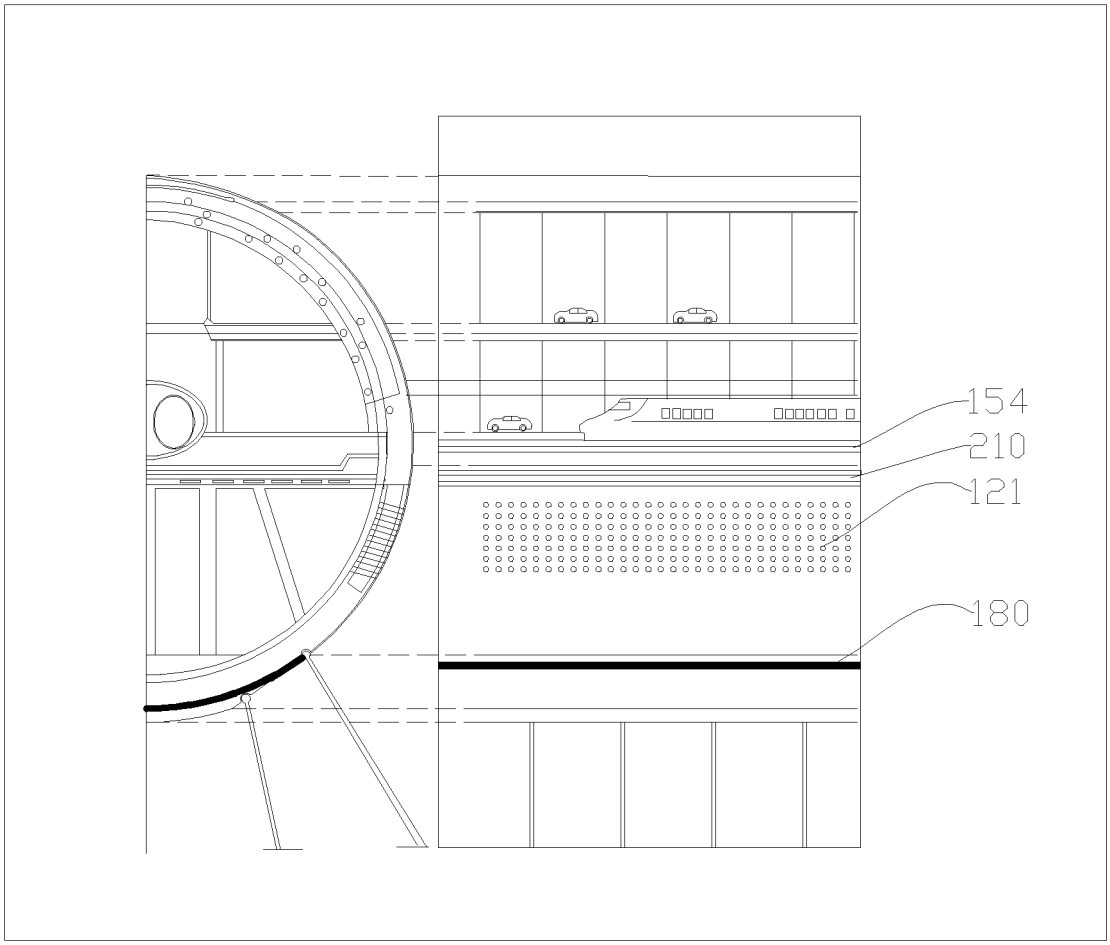
FIG. 2 is a schematic diagram of an axial section of an underwater traffic tunnel.

As shown in FIG. 1 and FIG. 2, the present invention provides an underwater traffic tunnel, which comprises a body 101 immersed in water, a connector, and a ventilation system. The shape of the body 101 is not limited, and can be a rectangular parallelepiped or an irregular polygon, etc. Preferably, it is convenient to produce and process and reduces the impact force against seawater. In this embodiment, the body 101 is cylindrical.

The body 101 comprises a first cavity 110 for providing a passage space and a second cavity 120 located below the first cavity 110, the second cavity 120 is in communication with water;

the connector connects the body 101 and the water bottom and is used to resist buoyancy, the ventilation system is in communication with the first cavity 110 and extends above the water surface, and the ventilation system is deformable to provide continuous ventilation when impacted.

The above underwater traffic tunnel can be provided in the sea (water) or in the seabed (water bottom). Preferably, the body 101 is provided at a position 20*m* below the water surface to ensure the free passage of ships. The deepest position is not restricted, and can be specifically set according to actual conditions.

The outer wall of the second cavity 120 can be reinforced with thick steel plates, and both side walls of the symmetry axis of the second cavity 120 are provided with water flow holes 121, through which the second cavity 120 is in communication with the water. At this time, seawater can flow into the second cavity 120 from both sides of the second cavity 120 at the same time. Preferably, the water flow holes 121 are provided above the two side walls of the second cavity 120. Compared with the water flow holes 121 provided below the second cavity 120, the seawater can easily fill the entire second cavity 120. At the same time, when the seawater impacts the second cavity 120, it flows into the water flow hole 121, which can reduce the impact force of the seawater on the second cavity 120 and reduce its shaking.

The above connector does not need to provide support only when resisting buoyancy. Specific connectors can be bolts 130, steel cables, cables, etc. These connectors can allow movement within a certain range, and are less affected by crustal movement, wind and waves, and are more stable in structure.

In the underwater traffic tunnel of the present invention, the body 101 is safely immersed in water, it is not easy to interact with marine vessels, and the vessel can navigate freely above the body 101; and at the same time, the second cavity 120 is connected to water. When the seawater impacts one side of the body 101, since the second cavity 120 is immersed in seawater, seawater can enter the second cavity 120, and the body 101 is not easily overturned by the seawater; the connector is stable and firm against the buoyancy of the body 101 and the impact of seawater on the side wall of the body 101; the ventilation system on the body 101 can deform when impacted to prevent damage and impact by external forces, ensuring that the traffic tunnel has good ventilation guarantee and is safer, and can reduce the impact of changes in the earth crust such as earthquakes on the body of the tunnel.

Embodiment 1

Figure 3:
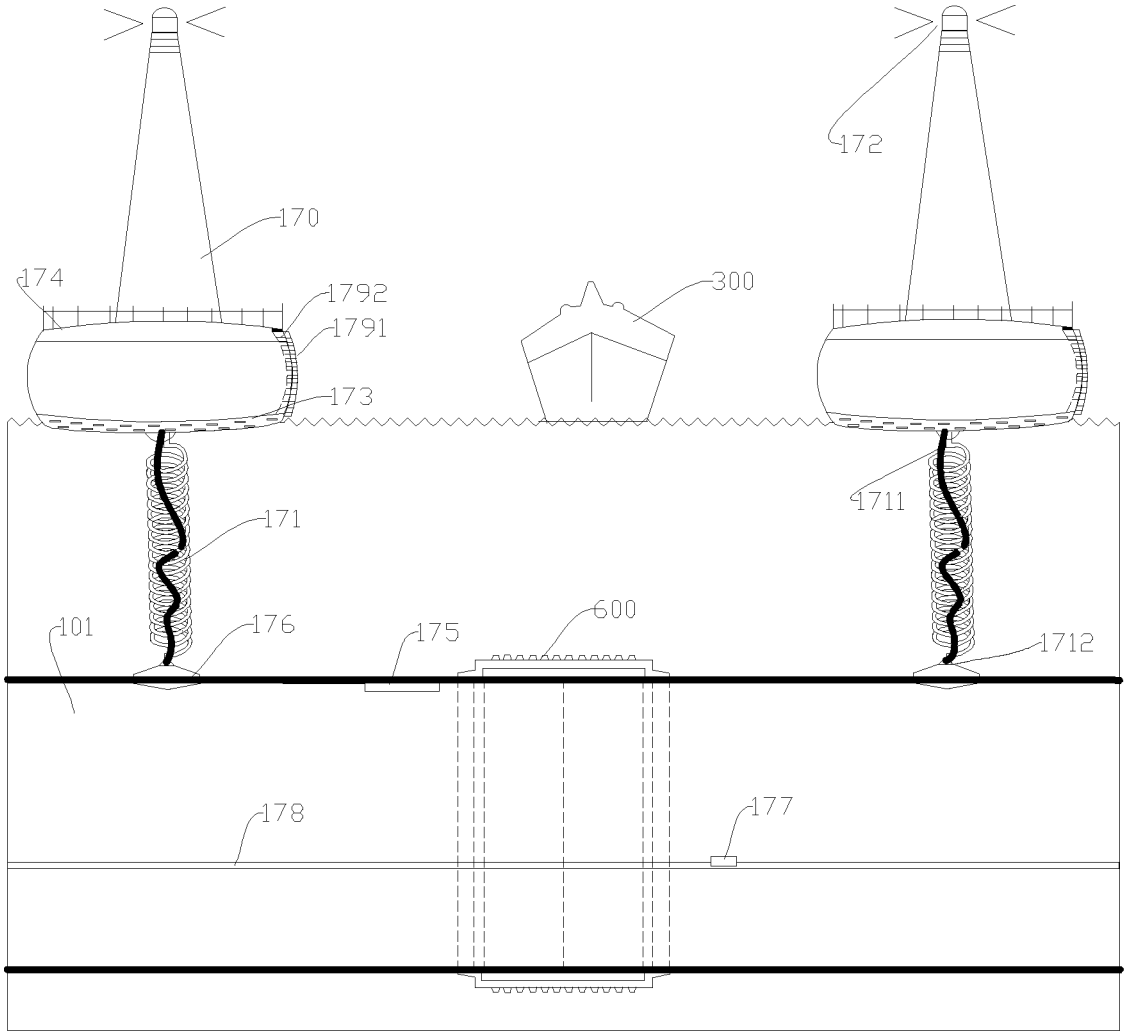
FIG. 3 is a schematic diagram of the structure of a ventilation system.

This embodiment provides a specific implementation of a ventilation system, which is deformable, and can buffer the impact of external force through deformation and ensure continuous ventilation at all times. As shown in FIG. 3, the ventilation system of this embodiment is provided at intervals along the extension direction of the body 101, and comprises a floating island 170 and a hose part 171 connecting the floating island 170 and the first cavity 110, wherein the floating island 170 is located above the water surface and is in the shape of a tower with an air port communicated with the hose part 171 on the upper part;

a water sealing valve 176 is provided between the bottom port of the hose part 171 and the first cavity 110, and the hose part 171 has a spiral shape to provide a deformation amount through expansion and contraction when impacted by an external force.

A limit part 1711 is further provided between the bottom of the floating island 170 and the body. The limit part 1711 is used to limit the expansion and contraction of the hose part 171 within a predetermined range. The limit part 1711 can be a high-strength rope body or a steel cable. As shown in FIG. 3, under normal conditions, the limit part 1711 connects the body 101 and the bottom of the floating island 170 in the hose part 171, which has a natural relaxed state; when impacted by an external force, the hose part stretches and continues to ensure ventilation. When the hose part stretches to a large extent, the limit part 1711 can reach a fully stretched state and limit the hose part to continue to stretch, preventing the hose part 171 from being unable to return to its original state. The hose part 171 may be made of plastic with high support performance. As shown in FIG. 3, the bottom end of the floating island 170 and the outer wall of the corresponding body 101 are both provided with a base 1712 for fixing the limit part 1711.

The bottom of the floating island 170 is provided with a counterweight layer to stabilize the structure, and the counterweight layer may be a structure such as a lead block. The entire floating island can be made of steel to ensure the stability of the structure, and the outside is covered with a plastic layer to prevent corrosion.

The floating island 170 described above is in the shape of a tower, and an air port is provided on the upper part of the floating island 170 to ensure that the air port is higher than the water surface and is not easily affected by sea surface navigation objects, wind waves, and water level changes. The hose part 171 is made of soft material, which is spirally stretchable and flexible. Even if the floating island 170 is impacted by a ship, the safety of the body 101 will not be affected, and the hose part 171 can be reset after being impacted and continue air intake and exhaust operations, preventing the ventilation system of the body 101 from being damaged and resulting in safety hazards when impacted by external forces. The water sealing valve 176 can be provided as a manual valve or an automatic sensing valve. When an automatic sensing valve is used, a controller and a water leakage sensor 177 can be electrically connected. The sealing water valve 176 can be closed when a safety hazard is detected by the water leakage sensor 177. The water sealing valve 176 can be manually closed at the end. The leak sensor is an existing mature technology, and its structure is not described in detail here.

As shown in FIGS. 1 and 2, the ventilation system is in communication with the first cavity 110. A lighting system is provided in the first cavity 110, and a passage road 150 for passage of vehicles is further provided in the first cavity 110. As shown in FIG. 1, the passage road 150 is provided with a suspension train passage area 151, an automobile passage area 152, and a viaduct 153. The suspension train passage area 151 and the automobile passage area 152 are provided at intervals. The bottom end of the viaduct 153 and the passage road 150 are connected through the first support column 161, and the top end of the viaduct 153 is connected to the top end of the body 101 through the second support column 162. Preferably, there are two automobile passage areas 152 and viaducts 153, which are located on both sides of the suspension train passage area 151, respectively; each automobile passage area 152 may be a single-lane or a multi-lane.

As shown in FIG. 1, the automobile passage area 152 in FIG. 1 is a two-way passage on both sides. A connecting bridge 155 is provided between the two single-lanes. The connecting bridge 155 is used to enable the driver to enter the opposite lane to drive in the opposite direction in an emergency. It is more convenient to use roads. As shown in FIG. 1, the connecting bridge 155 corresponding to the lower automobile passage area 152 crosses the suspension train passage area 151 and has a certain slope. Further, the suspension train passage area 151 is an independent tunnel. Preferably, the suspension train may be a magnetic suspension train or the like. Preferably, a hydraulic stabilization layer 154 can be provided at the bottom of the suspension train passage area 151. The hydraulic stabilization layer 154 can use existing voltage stabilizers or hydraulic pumps and other voltage stabilizing devices. The hydraulic stabilization layer 154 adjusts the pressure fluctuation in the suspension train passage area instantaneously caused by load or sea waves and maintains the balance of the tunnel in the suspension train passage area.

The safe and stable ventilation system described above is in communication with the first cavity 110, and the passage road can be ventilated stably and continuously with the ventilation system, ensuring the safety and stability of the passage of vehicles in the first cavity 110.

Figure 4:
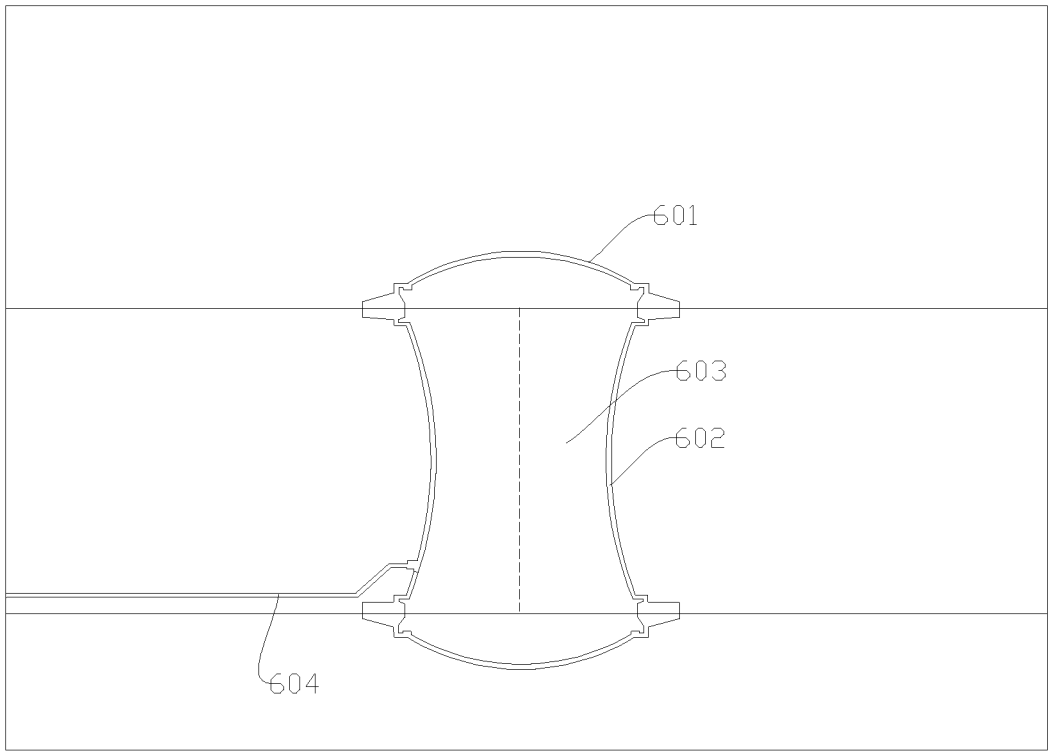
FIG. 4 is a schematic diagram of the structure of a sealing reinforcement component.

As an alternative embodiment, referring to FIGS. 3 and 4, the body 101 comprises a plurality of pipe bodies arranged and connected along the extending direction thereof, a sealing reinforcement component 600 is provided at the splicing position of the pipe body, and the sealing reinforcement component 600 comprises an outer enclosed shell 601 and an inner enclosed shell 602, wherein:

the outer enclosed shell 601 covers the periphery of the splicing position of the pipe body, the inner enclosed shell 602 comprises two sections located at two adjacent pipe bodies, the two sections of the inner enclosed shell 602 and the outer enclosed shell 601 encircle a closed working area 603, and the splicing position of the pipe body is located in the working area 603 to facilitate maintenance work.

After the plurality of pipe bodies constituting the body 101 are fixedly connected, in order to enhance the structural strength while preventing water from entering the splicing position, the sealing reinforcement component 600 described above is provided at the splicing position of the pipe body. The outer enclosed shell 601 and the inner enclosed shell 602 in the sealing reinforcement component 600 encircle a closed working area 603. The functions of the working area 603 are as follows: first, it is an aerobic environment, which is convenient for maintenance work here, and as shown in FIG. 3, a gas and electric pipeline 604 is connected to the working area 603 for repair or connection work; second, even if water enters through the outer enclosed shell 601, it will still exist in the working area 603 and be blocked by the inner enclosed shell 602 and cannot enter the inside of the first cavity 110; a drainage pipe 178 can be connected to the working area 603 to ensure instant drainage. The inner enclosed shell 602 described above is provided with a conveying opening door, through which workers, working devices, etc. can be conveyed to the working area 603.

Figure 10:
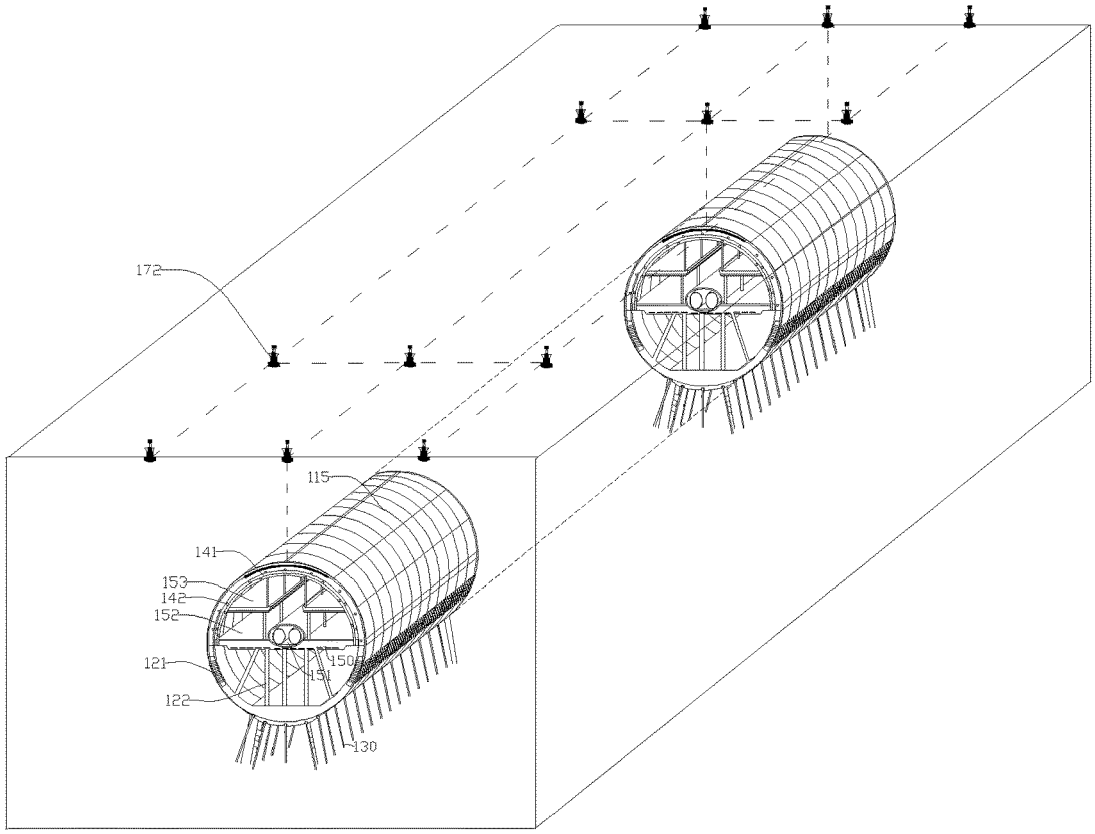
FIG. 10 is a schematic diagram of a layout structure of a warning system on the sea surface (water surface)

As shown in FIG. 10, a pipe wall expansion joint 115 is further provided along the passage direction of the body 101. The impact force of seawater can be buffered to a certain extent via the pipe wall expansion joint 115 to resist a certain degree of deformation. The streamlined pipe wall expansion joint 115 can reduce the resistance to the sea wind and sea waves to a certain extent, and the reaction force of the sea waves and sea wind on the body 101 will be correspondingly reduced, which can enhance the stability of the body 101.

Embodiment 2

Figure 5:
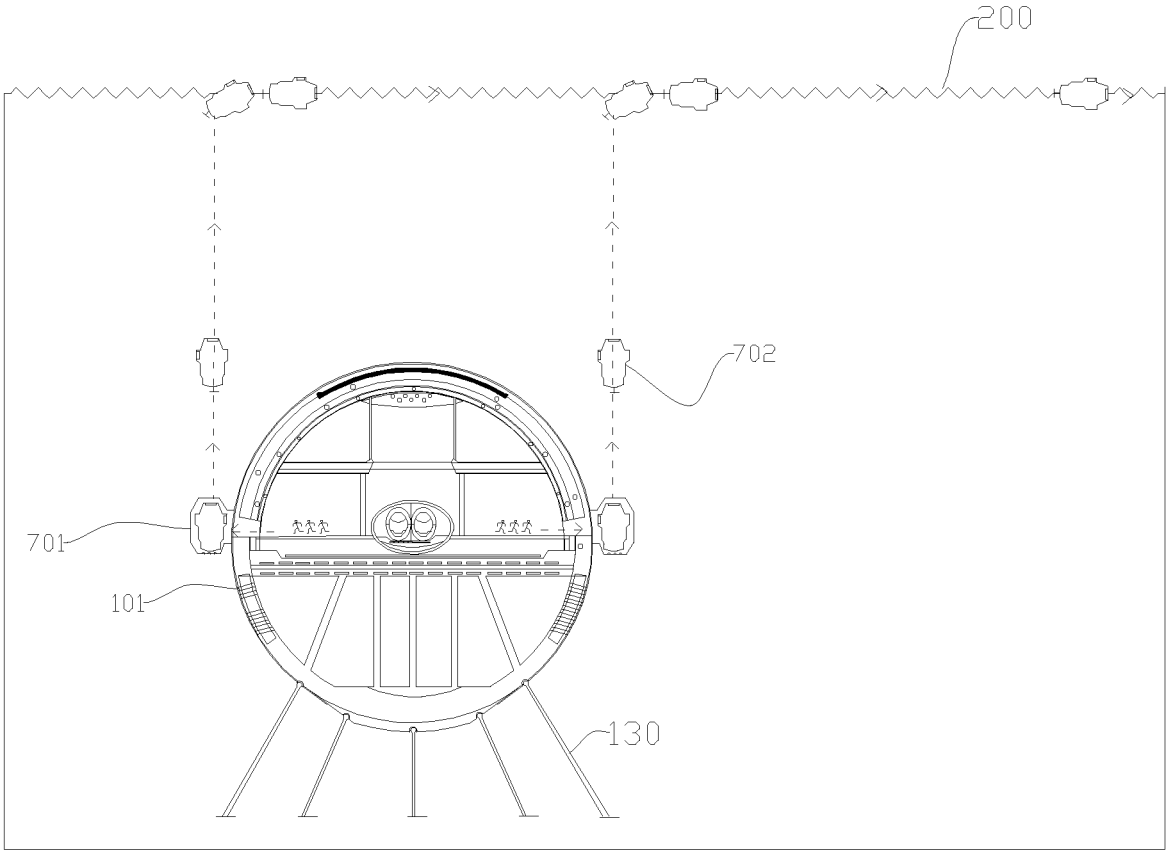
FIG. 5 is a schematic diagram of a first embodiment of an escape system.
Figure 6:
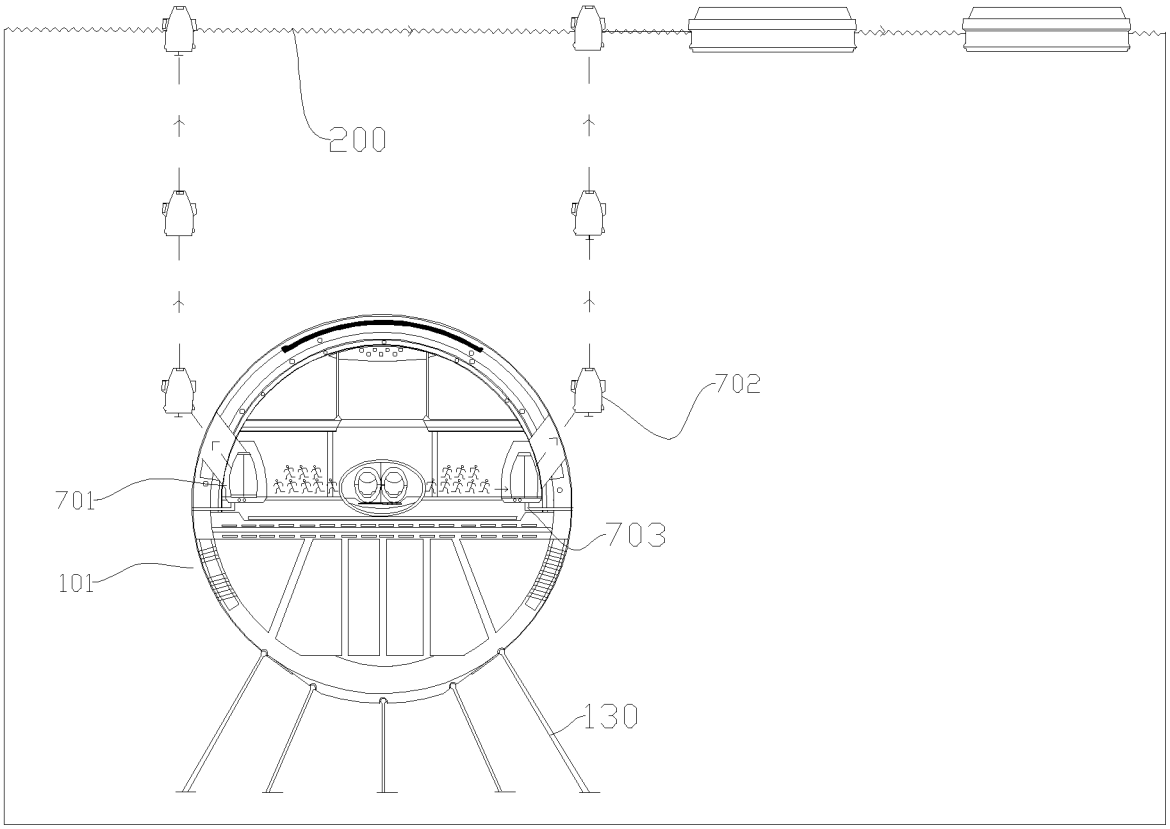
FIG. 6 is a schematic diagram of a second embodiment of an escape system.

This embodiment is an improvement made on the basis of the above embodiment 1. As shown in FIGS. 5 and 6, an escape system is provided on the body 101, and the escape system comprises a safety cabin 701 located outside the body 101 or inside the body 101 and an escape cabin 702 in the safe cabin 701;

the escape cabin 702 is provided with an aerobic space for accommodating people, and cabin doors provided on the sides and the top of the escape cabin are provided in the escape cabin 702, and a propeller propulsion system is configured on the escape cabin 702; a drainage structure 703 is provided in the safety cabin 701, and the drainage structure 703 is in communication with water.

The above structure can be a drainage pipe provided at the bottom of the safety cabin 701, the drainage pipe extends to water outside the body 101, and the drainage pipe and the safe cabin 701 are sealed by a water valve, which can be activated when drainage is required (the solenoid valve can be used and activated). The above escape cabin 702 can be completely sealed and is provided with an aerobic system, on which a propeller propulsion system and a wing are provided and which can carry escaping people to float to sea level 200 smoothly. The above escape cabin 702 can adopt existing devices on the market, and it is also easy to obtain the aerobic system and the propeller propulsion system in the field of marine transportation, the structure of which will not be described in detail here. Those skilled in the art can provide large or small escape cabins according to actual conditions. When a large escape cabin is used, the safety cabin 701 can be provided inside the body 101, as shown in FIG. 6.

The function of the above safety cabin is to protect the escape cabin from corrosion and to be able to normally operate safely and stably. The safety cabin itself can be made of corrosion-resistant high-strength material to ensure that it is not corroded by seawater or damaged by marine organisms.

The safety cabin 701 can be equipped with a first opening door and a second opening door. The first opening door can be provided on the side for people to enter, and the second opening door is provided on the top to release the escape cabin; specifically, the first opening door is connected to the inside of the first cavity 110 and the safety cabin 701, and the second opening door is connected to the safety cabin 701 and water. When an emergency occurs, people can be separated to both sides of the body 101 to the safety cabin 701, open the first opening door to enter the safety cabin 701, open the door of the escape cabin 702 to enter the escape cabin 702, then close the first opening door, and open the second opening door. The escape cabin 702 receives the buoyancy of water and enters water under the power of the propeller propulsion system, and gradually rises to the water surface to escape. The first opening door and the second opening door described above may adopt the existing automatic doors.

Figure 7:
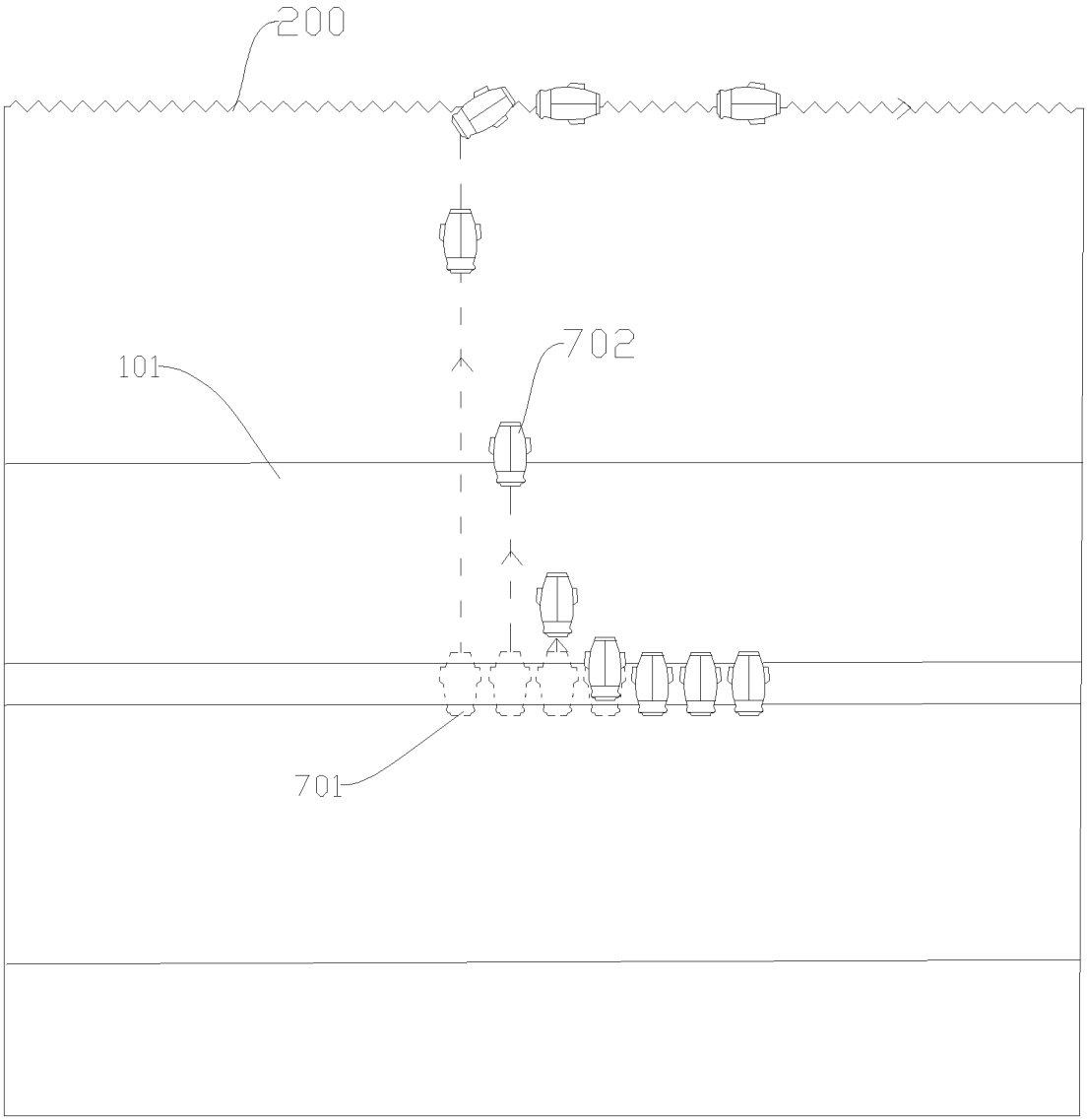
FIG. 7 is a schematic diagram of a layout structure of a small escape cabin.

As an alternative embodiment, referring to FIGS. 5 and 7, when a small escape cabin 702 is used, the safety cabin 701 can be placed outside the body 101, and there are a plurality of escape cabins 701 along the extension direction of the body 101 for sequential release.

A plurality of arranged small escape cabins 702 can provide enough space for people to use, and are arranged along the extension direction of the body 101 so as to facilitate people in a plurality of areas to reach the safe cabin 701 as soon as possible, which is more convenient and safer to use. The above escape system can provide safety guarantee for people in the underwater tunnel. In case of emergency, the escape system can be activated to ensure the safety of the underwater traffic tunnel.

Embodiment 3

Figure 8:
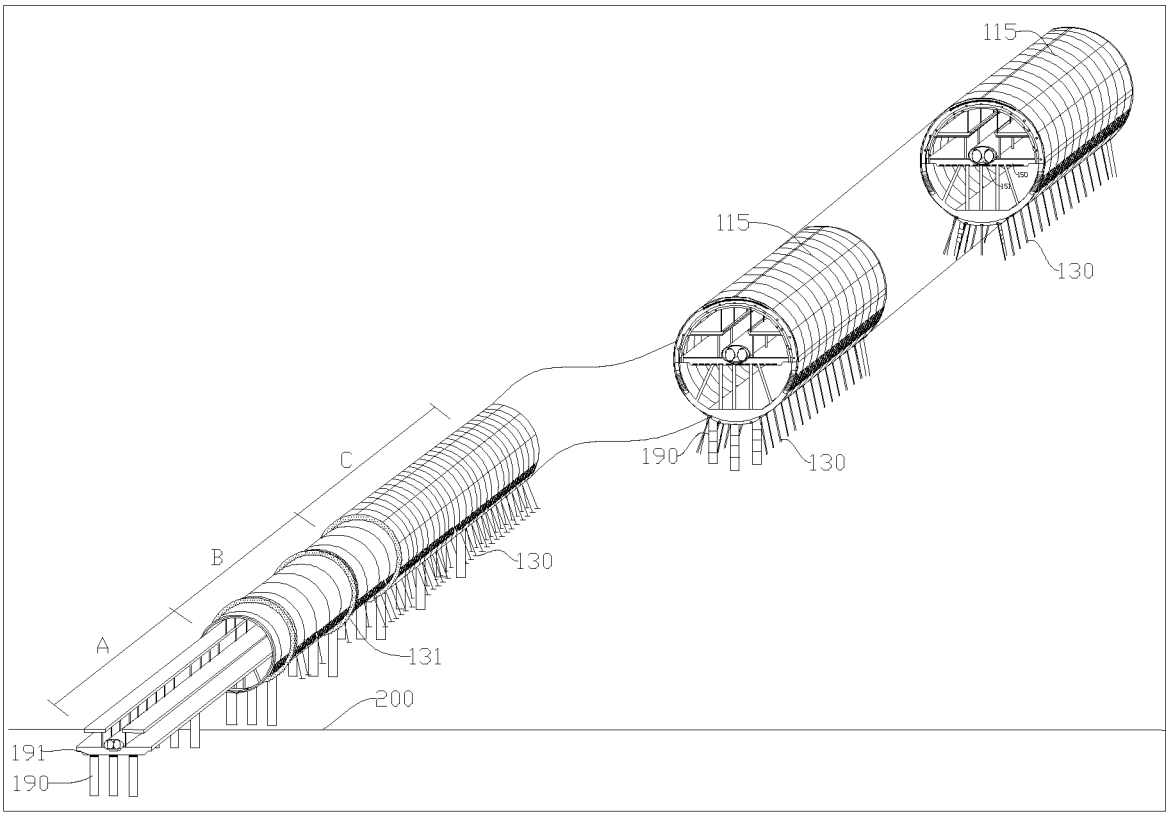
FIG. 8 is a schematic diagram of the structure of an underwater traffic tunnel near the coast.

This embodiment is an improvement made on the basis of the above embodiment. In order to enable the underwater traffic tunnel to stably and safely connect the two established areas, the above steel cables, anchor rods 130, etc. are more suitable for being provided in the part of the body 101 in water. As shown in FIG. 8, in this embodiment, both ends of the body 101 close to the land are connected with a transition part, the transition part comprises a land-based section, an entrance and exit transition section and a sea-based section connected by a ring-shaped anchor 131 in turn from land to water, the sea-based section gradually descends to communicate with the body 101; in other words, the body 101 is gradually connected to the land through the transition part.

A support column 190 is provided at the bottom of the land-based section, an elastic connector is provided between the support column 190 and the body 101, the elastic connector may be a spring ring 191; here, the support column 190 is used to provide supporting force for the transition part. There is almost no buoyancy here, so there is no need to provide the anchor 130; the support column is made of reinforced concrete to ensure the structural strength.

A support column 190 and an anchor rod 130 are provided at the bottom of the entrance and exit transition section, and an anchor rod 130 is provided at the bottom of the sea-based section.

At the beginning of the entrance and exit transition section B, the support column 190 of the reinforced concrete is mainly used for support, and the anchor 130 cooperates for fixation; at the sea-based section C, the body 101 gradually enters the sea (water), but at this time, the seawater is not enough to submerge the second cavity 120, and the bottom of the body 101 needs a certain supporting force. Therefore, the support column and the anchor rod 130 are combined and fixed. When the second cavity 120 is completely immersed in the sea to a sufficient depth, the body 101 is fixed by the anchor rod 130. Alternatively, at depths of 100 meters or even kilometers, steel cables can be used to replace anchor rods to better resist buoyancy. As shown in FIG. 4, in order to save cost, the above land-based section A may not be provided with a shell structure, the entrance and exit transition section B may be provided with a structure with a part of the outer wall and inner wall, and the sea-based section C may be completely provided with a four-layer structure of the shell.

Figure 9:
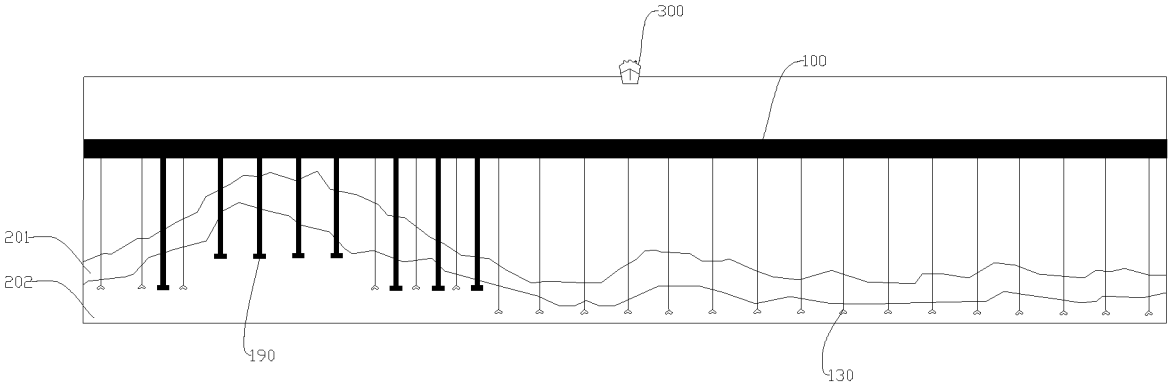
FIG. 9 is a schematic diagram of a fixing method of an underwater traffic tunnel according to a geological structure.

When the body 101 is located in the sea (water) due to the different geological conditions of the seabed, as shown in FIG. 9, the upper layer of the seabed is a seabed silt layer 201. Because of its unstable structure, the anchor 130 and the steel cable should not be fixed to this layer of structure. The lower part of the seabed silt layer 201 is usually a force-bearable rock layer 202, and the anchor rod 130, steel cables and other connectors are fixed here as much as possible. In order to enable the body 101 of the underwater traffic tunnel to adapt to the marine environment, as an optional embodiment, a support column 190 or a support pile connecting a rock layer is provided at the bottom of the body 101 located in the shallow sea area, a support column 190 and an anchor rod 130 and/or a steel cable connecting the rock layer are provided at the bottom of the body 101 located in the transition area, an anchor rod 130 and/or a steel cable connecting the rock layer is provided at the bottom of the body 101 located in the deep sea area, and the anchor rod 130 is used to resist buoyancy.

The above structure enables the body 101 to adapt to the sea or underwater environment, and the structure of the bottom can be flexibly provided according to the sea topography, so as to ensure a more stable structure and reduce the influence of crustal movement.

Embodiment 4

This embodiment is an improvement made on the basis of the above embodiment. This embodiment provides a more stable and implementable manner for the structure of the body 101. As shown in FIGS. 1 and 2, in this embodiment, the first cavity 110 consists of an outer wall 111 and an inner wall 112 provided at intervals. The inner wall 112 is a multilayer structure, as shown in FIGS. 1 and 2, comprising three inner walls 112. The outer wall 111 and the three-layer inner wall 112 are provided at intervals to form a three-layer cavity structure; moreover, a plurality of stabilizing mechanisms along the passage direction (or the length direction of the body 101) of the body 101 are provided in the three-layer cavity, that is, between the outer wall 111 and the adjacent inner wall 112 and between adjacent inner walls 112. A plurality of stabilizing mechanisms are provided at intervals; the stabilizing mechanism comprises a guide rail 141 provided along the width direction of the body 101. Specifically, when the passage road 150 is provided in the middle of the body 101 (on one diameter), the cross section of the guide rail 141 is in a semicircular arc shape.

A plurality of pulleys 142 are provided in the guide rail 141, each of the pulleys 142 is fixed in the guide rail 141 using the rotating shaft, the rotating shaft is provided along the passage direction of the body 101, and the pulley 142 abuts against the outer wall 111, the inner wall 112, and the adjacent inner wall, respectively.

After the above stabilization mechanism fixes the inner wall 112, when the outer wall 111 is rotated by the action of seawater, the pulley 142 can disperse the rotation of the outer wall 111, so that the inner wall 112 is not affected by the outer wall 111, ensuring that the passage space in the entire first cavity 110 is stable. The structure in which a three-layered inner wall 112 is provided in the outer wall 111 can slow down the acting force of seawater layer by layer and keep the innermost passage road more stable without being affected by the outer layer. Preferably, a plurality of pulleys 142 are evenly provided in the guide rail 141.

The outer wall of the body 101 can be made of high-resin fiber, and the inner wall is made of high-strength steel. At the same time, the use of high-resin fiber and steel can not only resist corrosion, but also ensure the strength of the body 101.

The bottom end of the second cavity 120 is further provided with a counterweight layer 180. The counterweight layer 180 is directly provided at the bottom end of the second cavity 120 mainly using some relatively dense materials (such as filling some corrosion-resistant steel plates, lead blocks, etc.). The advantage of this configuration is that using the counterweight layer 180 to adjust the ratio of the counterweight, the center of gravity of the entire body 101 will move down, so that the body 101 is more stable and not easy to tip over.

In order to enhance the stability of the second cavity 120, that is, the body 101, as shown in FIGS. 1, 2 and 3, a support post 122 is provided inside the second cavity 120, and the support post 122 is used to connect the inner wall of the second cavity 120 and the top end. The support column 122 at least comprises a vertical post provided in the middle of the second cavity 120 and an inclined post provided on both sides of the vertical post. The three support posts 122 in the middle are provided perpendicular to the passage road, and their function is mainly to support the passage road. The other two support posts 122 are symmetrically provided on both sides of the vertical post and connect the side wall of the second cavity 120 and the passage road 150, and their function is to slow down the impact force of seawater after entering the second cavity 120 and prevent it from having a greater impact on the stability of the body 101.

In order to prevent the passage road from being affected by ocean currents to destroy its the stability, a hydraulic stabilizing device is provided at the junction between the first cavity and the second cavity 120, and the hydraulic stabilizing device supports the bottom of the road surface to balance the pressure of the passage road. The above hydraulic stabilizing device can use the existing voltage stabilizer 210 to uniformly support the passage road, and the voltage stabilizer adjusts the pressure fluctuation in the road surface instantaneously caused by load or sea waves and maintains the balance of the passage road.

Embodiment 5

This embodiment is an improvement made on the basis of the above embodiment 1. As shown in FIGS. 3 and 10, a base 173 is provided at the bottom of the floating island 170, a solar panel 174 is provided on the base 173, the solar panel 174 is electrically connected with a power storage device 175 through the ventilation system, and the power storage device 175 is provided in the body 101 and is connected to the power consuming device therein.

In addition to having the function of fixing the air port of the ventilation system, the floating island 170 described above can also be provided with a base 173 and a solar panel 174 on the base 173. The solar panel 174 is connected to a battery, and the natural resource can be used to generate and store electricity, so as to provide power protection for the power consuming device in the underwater tunnel as a reserve of electrical energy.

The navigating vessel can sail freely on the sea above the tunnel. In order to prevent the sea surface activities such as military exercises and dumping from affecting the tunnel body 101, as an optional implementation, as shown in FIG. 3, FIG. 10 and FIG. 11, in this embodiment, a warning system is provided at the position of the body 101 corresponding to the water surface, the warning system comprises a plurality of warning buoys 172 for forming warning areas and a sonar device issuing a warning signal, and the warning buoy 172 is fixed on a floating island 170 or a buoyant tower.

In order to facilitate the maintenance of the device, preferably, an external service ladder 1791 extending from bottom to top is provided outside the floating island, and a service port is provided on the base 173. An inner service ladder 1792 connected to the service port is provided in the base, so as to facilitate the maintenance of internal facilities such as solar panels and counterweight layers. The base 173 is provided with a guardrail for protection.

The bottom area of the base 173 of the floating island should be able to meet the requirements of stability, and its height should be able to prevent a sailing vessel 300 from colliding with the upper air port, so that the warning system thereon can be easily observed by the distant sailing vessel 300 and avoid collisions in time. As shown in FIG. 3, the base 173 has a certain bottom area and height to prevent the sailing vessel from colliding with the upper air port, the warning device, etc.

Figure 11:
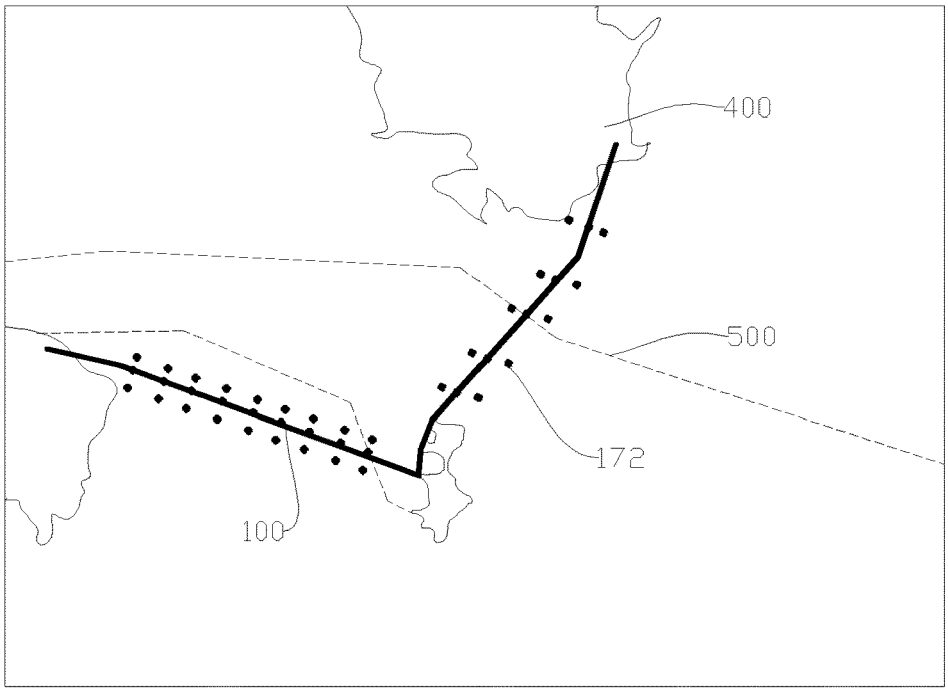
FIG. 11 is a top view of an underwater traffic tunnel connecting the coast and the intersection with the route.

As shown in FIG. 11, the underwater traffic tunnel connects the land 400 on both sides of the sea across the sea, and can connect the islands near the land and serve as a transit station. Sailing vessels can travel freely along the established route 500 and will not be affected by the underwater traffic tunnel 100. In order to warn about sea activities such as exercises and dumping, further, warning areas surrounded by warning buoys 172 are provided on both sides along the passage direction of the body 101. It should be noted that a plurality of warning buoys 172 can be provided along the passage direction of the body 101. In addition, a radar early warning and acousto-optic wave automatic warning and prompting system can also be used to prevent ships or submarine submarines from approaching, which can prevent other submarines from colliding with the body 101 and has better safety performance.

The sonar device is the prior art in the field of maritime traffic, the structure of which is not described in detail here. Once it detects that the underwater vehicle is approaching, it can immediately issue a warning signal to prevent impacting the tunnel and ensure safety.

The position of the tunnel body 101 below is marked on the sea surface through the above warning system, which serves as a warning to prevent military exercises, dumping and other activities from damaging the tunnel nearby.

In summary, the underwater traffic tunnel provided by this embodiment has at least the following advantages.

1. Vessels can navigate freely above the traffic tunnel, seawater can penetrate the lower part of the tunnel, and the tunnel is located below the sea surface, which is not easily disturbed by water currents and sea wind.

2. The ventilation system is fully flexible and is able to withstand a certain degree of external impact, etc., and can be continuously and stably ventilated in the first cavity 110; the sealing reinforcement component 600 double-seals and protects the pipe body junction to prevent water from entering a plurality of sections of the pipe bodies 101.

3. The escape system can provide safety guarantee for the traffic tunnel. When an emergency occurs, people can use the escape system to escape to the water surface to ensure its safety and reduce the impact of changes in the earth crust such as earthquakes on the body of the tunnel.

4. According to the geological structure, the tunnel can be provided with a support column of reinforced concrete at a depth of about 150 meters in seawater, or the support column and the anchor rod 130 are fixed in combination so that the support force and the buoyancy are combined to ensure the stability of the tunnel, and it is not vulnerable to the influence of the earth crust.

5. A warning system is provided to prevent sea surface activities from affecting the tunnel, prevent the underwater vehicle from approaching and colliding when approaching, and ensure safety.

In the description of this specification, specific features, structures or characteristics can be combined in any one or more embodiments or examples in a suitable manner.

The above are only specific embodiments of the present invention, but the protection scope of the present invention is not limited thereto. Any changes or substitutions conceivable to those skilled in the art within the technical scope disclosed by the present invention should be covered within the protection scope of the present invention. Therefore, the protection scope of the present invention should be subject to the protection scope of the claims.

What is claimed is:

1. An underwater traffic tunnel, comprising a body immersed in water, a connector and a ventilation system, wherein:

the body comprises a first cavity for providing a traffic passage space and a second cavity located below the first cavity, and the second cavity is in communication with water;

the connector connects the body and the water bottom and is used to resist buoyancy, the ventilation system is in communication with the first cavity and extends above the water surface, and the ventilation system is deformable and movable to provide continuous ventilation when impacted;

wherein the first cavity consists of an outer wall and an inner wall provided at intervals, the inner wall is a multilayer structure, a plurality of stabilizing mechanisms along the traffic passage direction of the body are provided between the outer wall and the inner wall and between adjacent inner walls, the stabilizing mechanism comprises a guide rail provided along the width direction of the body, a plurality of pulleys are provided in the guide rail, each of the pulleys is fixed in the guide rail using the rotating shaft, the rotating shaft is provided along the traffic passage direction of the body, and the pulley abuts against the outer wall, the inner wall, and the adjacent inner wall, respectively.

2. The underwater traffic tunnel according to claim 1, wherein the ventilation system is arranged at intervals along the extension direction of the body, and comprises a floating island and a hose part connecting the floating island and the first cavity, wherein:

the floating island is located above the water surface and is in the shape of a tower with an air port communicated with the hose part on the upper part;

a water sealing valve is provided between the bottom port of the hose part and the first cavity, and the hose part has a spiral shape to provide a deformation amount through expansion and contraction when impacted by an external force.

3. The underwater traffic tunnel according to claim 1, wherein the body comprises a plurality of pipe bodies arranged and connected along the extending direction thereof, a sealing reinforcement component is provided at the splicing position of the pipe body, and the sealing reinforcement component comprises an outer enclosed shell and an inner enclosed shell, wherein:

the outer enclosed shell covers the periphery of the splicing position of the pipe body, the inner enclosed shell comprises two sections located at two adjacent pipe bodies, the two sections of the inner enclosed shell and the outer enclosed shell encircle a closed working area, and the splicing position of the pipe body is located in the working area to facilitate maintenance work.

4. The underwater traffic tunnel according to claim 1, wherein an escape system is provided on the body, and the escape system comprises a safety cabin located outside the body or inside the body and an escape cabin in the safe cabin;

the escape cabin is provided with an aerobic space for accommodating people, and cabin doors provided on the sides and the top of the escape cabin are provided in the escape cabin, and a propeller propulsion system is configured on the escape cabin;

a drainage pipe is provided in the safety cabin, and the drainage pipe is in communication with water.

5. The underwater traffic tunnel according to claim 4, wherein when the safety cabin is located outside the body, there are a plurality of escape cabins along the extension direction of the body for sequential release.

6. The underwater traffic tunnel according to claim 1, wherein both ends of the body close to the land are connected with a transition part, the transition part comprises a land-based section, an entrance and exit transition section and a sea-based section connected by a ring-shaped anchor in turn from land to water, the sea-based section gradually descends to communicate with the body;

a support column is provided at the bottom of the land-based section, an elastic connector is provided between the support column and the body, a support column and an anchor rod are provided at the bottom of the entrance and exit transition section, and an anchor rod is provided at the bottom of the sea-based section.

7. The underwater traffic tunnel according to claim 1, wherein a support column connecting a rock layer is provided at the bottom of the body located in the shallow sea area, a support column and an anchor rod and/or a steel cable connecting the rock layer are provided at the bottom of the body located in the transition area, an anchor rod connecting the rock layer is provided at the bottom of the body located in the deep sea area, and the anchor rod is used to resist buoyancy.

8. The underwater traffic tunnel according to claim 2, wherein a base is provided at the bottom of the floating island, a solar panel is provided on the base, the solar panel is electrically connected with a power storage device through the ventilation system, and the power storage device is provided in the body and is connected to the power consuming device therein.

9. The underwater traffic tunnel according to claim 1, wherein a warning system is provided at the position of the body corresponding to the water surface, the warning system comprises a plurality of warning buoys for forming warning areas and a sonar device issuing a warning signal, and the warning buoy is fixed on a floating island or a buoyant tower.

* * * * *